US006974135B2

(12) United States Patent
Melancon et al.

(10) Patent No.: US 6,974,135 B2
(45) Date of Patent: Dec. 13, 2005

(54) VARIABLE BORE RAM

(75) Inventors: Jeffrey T. Melancon, Willis, TX (US); David J. McWhorter, Magnolia, TX (US)

(73) Assignee: Varco I/P Inc., Houston, TX (US)

( * ) Notice: Subject to any disclaimer, the term of this patent is extended or adjusted under 35 U.S.C. 154(b) by 0 days.

(21) Appl. No.: 10/769,022

(22) Filed: Jan. 30, 2004

(65) Prior Publication Data

US 2005/0006087 A1 Jan. 13, 2005

Related U.S. Application Data

(60) Provisional application No. 60/486,499, filed on Jul. 11, 2003.

(51) Int. Cl.[7] ..... E21B 33/06

(52) U.S. Cl. ..... 277/325; 251/1.2

(58) Field of Search ..... 277/325; 251/1.1–1.3

(56) References Cited

U.S. PATENT DOCUMENTS

| | | | | |
|---|---|---|---|---|
| 2,749,078 | A * | 6/1956 | Losey | 277/325 |
| 3,897,038 | A | 7/1975 | LeRouax | |
| 3,897,071 | A * | 7/1975 | Le Rouax | 277/325 |
| 3,917,293 | A * | 11/1975 | Lewis et al. | 277/327 |
| 4,229,012 | A | 10/1980 | Williams, III | |
| 4,444,404 | A * | 4/1984 | Parks, Jr. | 277/325 |
| 5,005,802 | A | 4/1991 | McWhorter et al. | |
| 5,294,088 | A * | 3/1994 | McWhorter et al. | 251/1.3 |
| 6,089,526 | A | 7/2000 | Olson | |
| 6,367,804 | B1 | 4/2002 | Watts | |
| 6,857,634 | B2 * | 2/2005 | Araujo | 277/325 |

* cited by examiner

*Primary Examiner*—Alison K. Pickard
(74) *Attorney, Agent, or Firm*—Law Office of Tim Cook

(57) ABSTRACT

A ram type blowout preventer includes variable ram packers for sealing about tubulars of different outside diameters in the bore of the preventer housing or about a single tubular having a variable outside diameter. Each ram packer includes a body of elastomeric material formed about vertical ribs to conform to tubular having variable OD within a certain range.

7 Claims, 4 Drawing Sheets

VARIABLE BORE RAM

This Application claims the benefit of Provisional Application Ser. No. 60/486,499 filed Jul. 11, 2003.

FIELD OF THE INVENTION

The present invention relates generally to the field of blowout preventers (BOPs), and, more particularly, to a ram packer that accommodates tubulars of varying diameters or of one tubular having a varying diameter.

BACKGROUND OF THE INVENTION

Blowout preventers maintain control of downhole pressure in wells during drilling, and ram-type blowout preventers are used to close and seal around a string of pipe or coiled tubing extending into the well to contain the pressure within the well. Variable bore packers have been designed for ram-type blowout preventers to close and seal around tubular members having different diameters within a limited range of sizes. Variable bore packers are designed to adjust their sealing engagement to the particular size of tubular member passing through the ram-type blowout preventer. Various types of prior art variable bore packers have been utilized.

U.S. Pat. No. 4,229,012 discloses a variable bore packer for a ram-type blowout preventer in which irising inserts, operated like a camera shutter, are embedded in a resilient packer. Each insert includes an upper plate, a lower plate, and a rib fixed between the upper and lower plates. Each of the plates is generally triangular in shape and designed to rotate as it moves inwardly with the resilient packer annulus so that the resilient material is supported when in sealing engagement with the exterior of a tubular member extending through the BOP.

U.S. Pat. No. 5,005,802 discloses a variable bore packer having an upper and lower plate embedded in resilient packer material. A series of upper insert segments are positioned in the packer material below the upper plate and are removable with the packer material as it moves forward during sealing. The insert segments move inward with the packer material in sealing to provide an upper anti-extrusion support for the packer material upon sealing engagement around the exterior of a tubular member extending through the blowout preventer. The insert segments include an inner radius sized to match the outside diameter of the pipe against which it is to seal. The insert segments also include a radial length which is sufficiently long to allow them to move into engagement with a pipe exterior and still provide support for the resilient packer material to avoid its extrusion.

As variable bore packers sealingly engage tubular strings of different sizes, it is important to prevent the extrusion of the resilient packer material between the variable bore packer and the tubular member. Prior art packers continue to be subject to extrusion such that upon closing the variable bore packer around the tubular member, minute gaps continue to exist between the packer and tubular member. Such gaps become an increasing problem as the packer wears and is abraded by its sealing engagement with various tubular members passing through the blowout preventer. At times, a "stripping" operation must be performed to strip the string through the closed rams. This stripping movement can severely wear or abrade the face of the resilient packer material.

The problem of extrusion is enhanced with increased downhole pressure and/or increased temperature. As downhole pressures increase to 15,000 psi, such large downhole pressures exacerbate the problem of extrusion due to the great pressure differential across the packer. Seventy or eighty pressure cycles is a typical life span for ambient temperature packers. In high temperature packers, however, much more wear occurs in one cycle than in an ambient temperature packer. Further, as temperatures increase to high temperatures in the order of 350° F., the viscosity of the resilient packer material decreases causing it to be more fluid and thereby more susceptible to extrusion through the minute gaps between the packer and tubular member.

The variable bore packer of U.S. Pat. No. 4,229,012 does not lend itself to high temperature applications because it does not create a tight seal around the tubular member. The irising inserts cannot conform well to the diameter of the tubular member and leave a plurality of small gaps allowing extrusion by the less viscous packer material.

McWhorter et al., in U.S. Pat. No. 5,005,802, provided a packer for use with a ram-type blowout preventer having the capacity to accommodate a plurality of sizes of tubular members extending through the bore of the blowout preventer. The packer had a resilient body to fit the face recess of the ram and a central recess to receive a tubular member, an upper plate positioned in the upper portion of the resilient body, a lower plate positioned in the lower portion of the resilient body, and a plurality of metal insert segments positioned between the upper surface of the resilient body and the under surface of the upper plate and around the central recess of the resilient body.

In U.S. Pat. No. 5,294,088, McWhorter et al. provided another variable bore packer for a ram-type blowout preventer. The packer included a body of resilient packing material with upper and lower plates embedded in the upper and lower surfaces of the body and upper and lower sets of insert segments disposed adjacent the upper and lower plates. Each of the insert segments includes a pair of insert plates forming an arcuate opening to receive an appropriate sized tubular member and dimensioned to expand and move rearwardly in the resilient packing material upon engagement with a larger diameter tubular member.

However, new tubulars in use in the field include a first section of a first diameter, a second section of a second diameter, and tapered section joining the first and second sections. The prior art packers just described are not well adapted to accommodate this new design of tubulars. Further, known packers suffer from excessive tensile stress when subjected to high pressure differentials. The present invention is directed to solving this problem in the art.

SUMMARY OF THE INVENTION

The ram of the present invention seals around downhole tubulars, such as for example drill pipe, coiled tubing, and the like, of varying outside diameters at pressures up to 15,000 psi. The ram is provided as a part of a blowout preventer. In a manner known in the art, ram elements work in pairs driven by two opposing pistons. A sealing element comprises elastomeric material with embedded metallic inserts that prevent extrusion under pressure. These sealing elements are nested within a metallic ram block. In the present invention, the sealing elements flexibly adapt to various sizes of tubulars within a given range.

A two piece support "bone" eliminates tensile stress in the bone column experienced by certain known rams. This support bone allows the column to be of a reduced size which allows for more and better rubber flow. The column is used only for rigidity during the molding process and to coordinate the movements of the upper and lower pie shaped ends of the "bone". In prior art ram designs, the column must be so large that it would impede rubber flow.

All metallic members of the sealing element are mechanically locked to the ram while still having freedom of movement. Parts can not fall down hole even if all rubber is lost from the ram. Known rams can drop inserts downhole if the rubber is lost.

Bones are linked to slots in the upper and lower plates which, in addition to preventing loss downhole, strictly regulate the direction of motion of the inserts as they flex to conform to the pipe.

The combination of bones and upper and lower plates gives the ram of the present invention minimum extrusion points between variable sizes of pipe and a flush front face packer design. Other ram designs have inserts protruding beyond the frontal plane of the seal. Such designs are hard to mold in existing pipe ram front seal tooling, and suffer other problems.

These and other features and advantages of this invention will be readily apparent to those skilled in the art.

BRIEF DESCRIPTION OF THE DRAWINGS

So that the manner in which the above recited features, advantages and objects of the present invention are attained and can be understood in detail, more particular description of the invention, briefly summarized above, may be had by reference to embodiments thereof which are illustrated in the appended drawings.

DETAILED DESCRIPTION OF A PREFERRED EMBODIMENT

Figure 1:
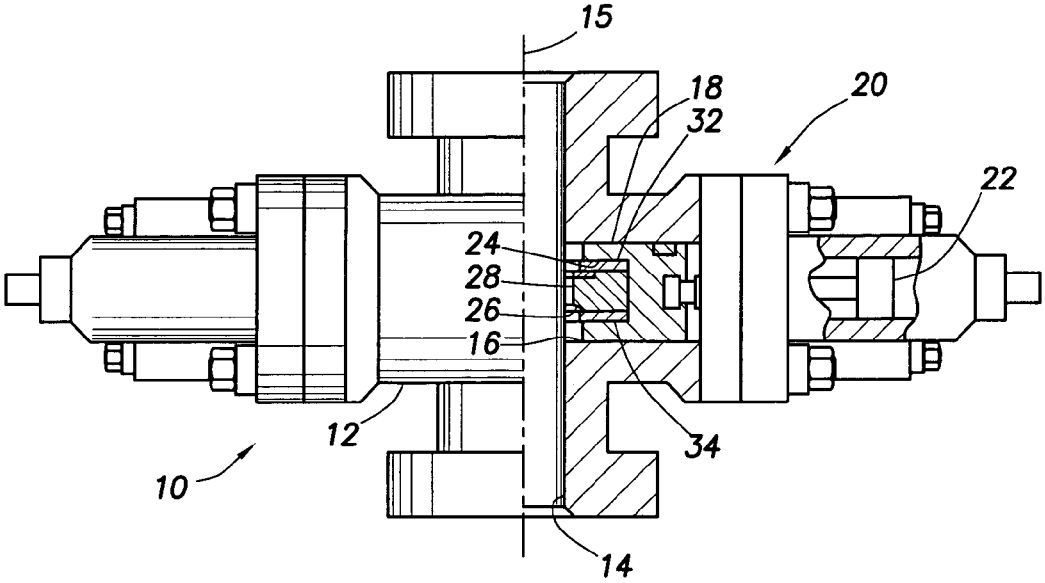
FIG. 1 (PRIOR ART)
FIG. 1 is a side view, partially in section, of a ram-type blowout preventer in which the packer of the present invention is installed.

Referring initially to FIG. 1, there is shown a ram-type blowout preventer 10 which includes a housing or body 12 having a central vertical bore 14 therethrough with aligned opposed ram guideways 16 extending radially outward through body 12 from opposite sides of bore 14. The bore 14 defines a central axis 15. The blowout preventer 10 is similar to the blowout preventer illustrated in U.S. Pat. No. 5,005,802, incorporated herein by reference. Each guideway 16 has a generally round, oval, or rectangular cross-section and includes a ram 18 reciprocally disposed therein. Each ram 18 is connected to an actuation means 20, such as a piston 22, by an actuator connecting rod 24 for moving rams 18 axially within their respective guideways 16 to open or close bore 14. While only one guideway 16 and ram 18 are shown, it is understood that there are two opposed guideways 16 and a ram 18 in each guideway 16.

Each ram 18 includes a front face slot 26, only partially shown, for receiving a suitable packer therein with means coacting with the packer for securing it within slot 26. Packers normally are made of a resilient material and function to engage and seal against the exterior of a tubular member (not shown) which extends through central bore 14 and against which the ram packers are to close. Ram top seal 28 extends across the top of each ram 18 in groove 30 to provide a seal between ram 18 and the interior of guideway 16. Top ram seal 28 coacts with the packer to retain well pressure below rams 18 when rams 18 are in the closed position.

Figure 2:
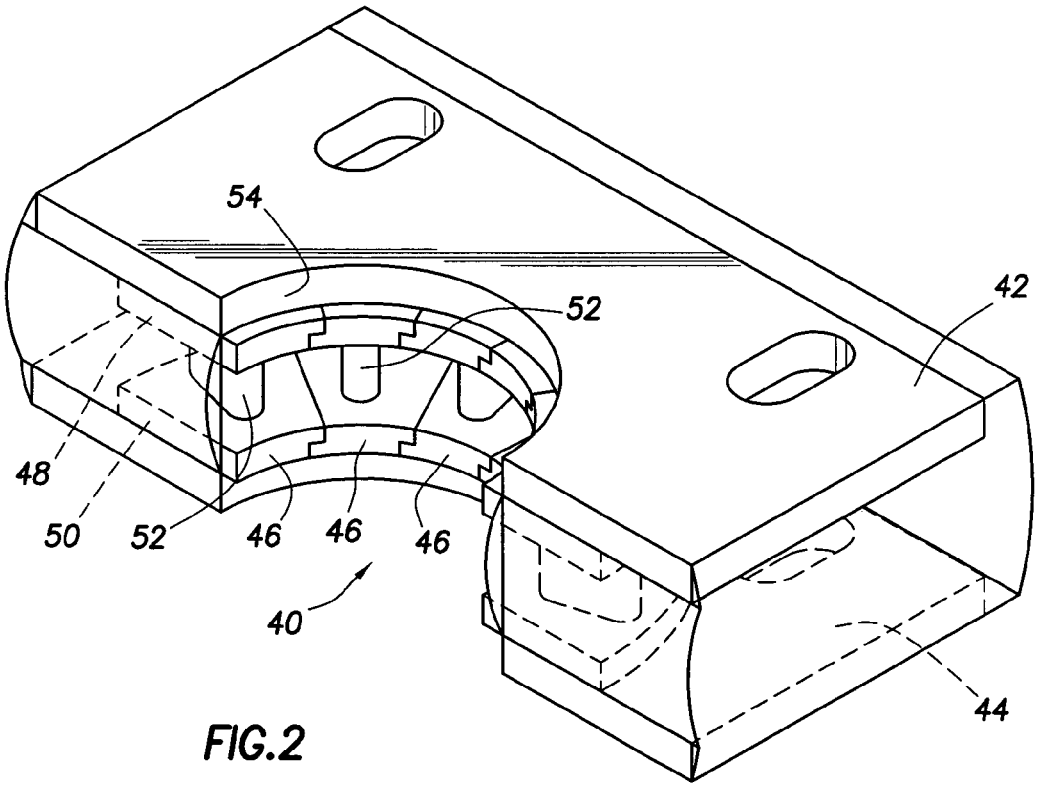
FIG. 2 is a perspective view of a ram of this invention.

The ram shown in FIG. 1 has proved to be effective for the purposes for which it was designed, but suffers the drawbacks previously mentioned. The present invention comprises a ram that seals around tubular of a varying outside diameter and seals at high pressure, and is shown in detail in FIG. 2. A ram element 40 includes an upper plate 42, a lower plate 44, and a plurality of wedge-shaped sealing elements 46 between the upper and lower plates. Each of the wedge-shaped sealing elements includes an upper plate 48, a lower plate 50, and a vertical rib 52 between the upper and lower plates.

The upper plate 42 defines an arcuate surface 54 of a first diameter and the upper plate 48 and the lower plate 50 of the wedge-shaped elements 46 also define an arcuate surface having a second diameter smaller than the first diameter of the arcuate surface 54.

Figure 3:
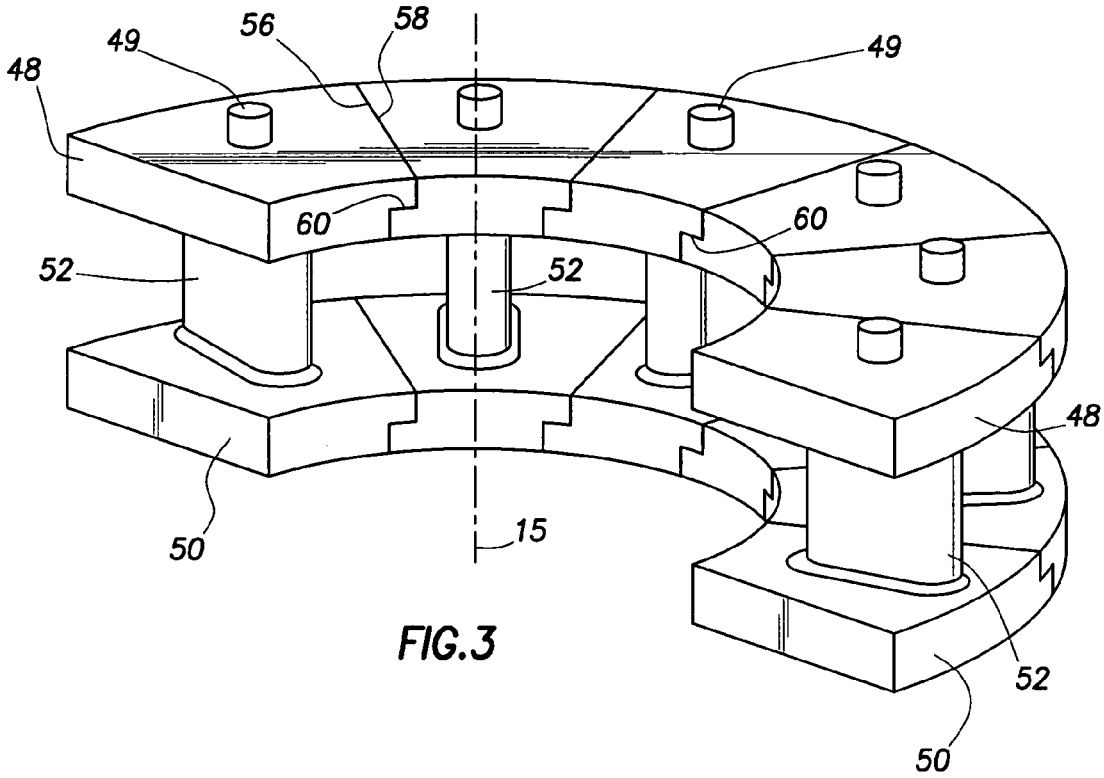
FIG. 3 is a perspective view of metal support elements for the elastomeric sealing components of the invention.
Figure 6B:
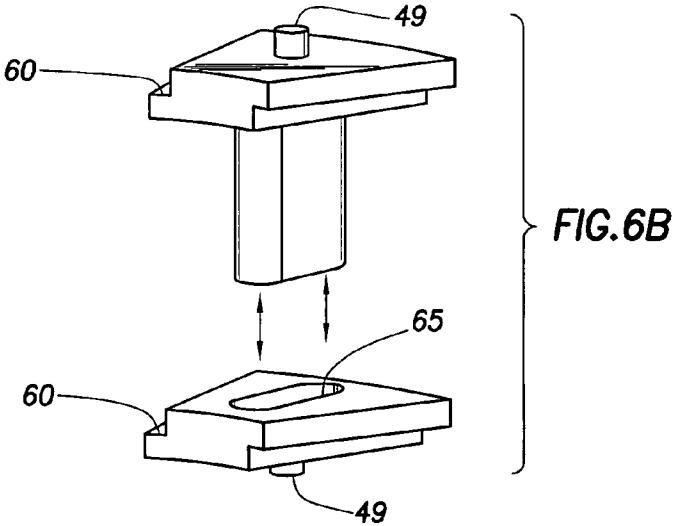
FIGS. 6A through 6D depict various views of one metal support segment.
Figure 6D:
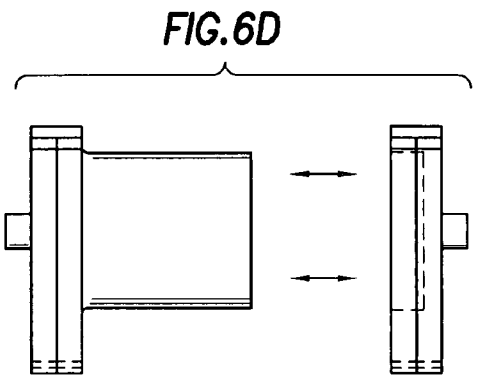
Figure 6A:
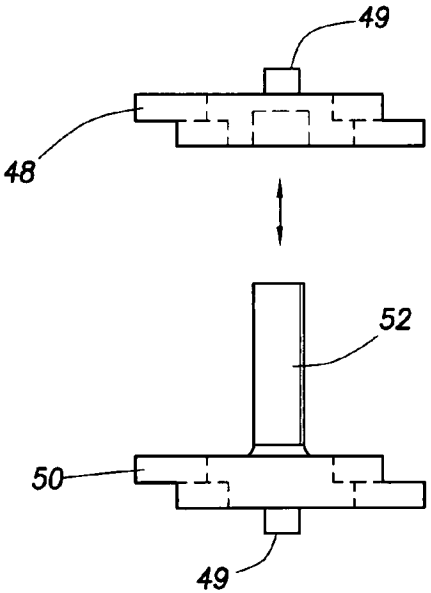
Figure 6C:
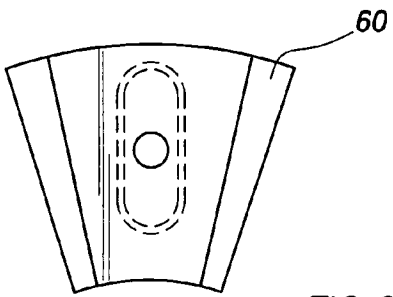

FIG. 3 shows more details of the wedge-shaped sealing elements including the upper plate 48, the lower plate 50, and the vertical rib 52 between the upper and lower plates. A plurality of the sealing elements is nested together to form an entire sealing device, and the entire sealing device is oriented about the axis 15 (see FIG. 1). Each of the pie-shaped sections of the upper plate 48 has a straight side 56 and a straight side 58, fitting together with a step 60 therebetween. This step 60 permits the sides of the pie-shaped sections to slide relative to one another, supporting each other vertically without creating an axial tensile stress between elements. Note also that the ribs 52 are merely supported between the plates and are not fixed thereto as shown below in FIGS. 6A and 6B, thereby eliminating the tensile stress common in the art.

Each upper plate 48 includes an upwardly extending pin 49 therefrom. A similar pin extends below the lower plate 50. The pins coact with grooves in the upper and lower plates 42 and 44 as shown below.

Figure 4:
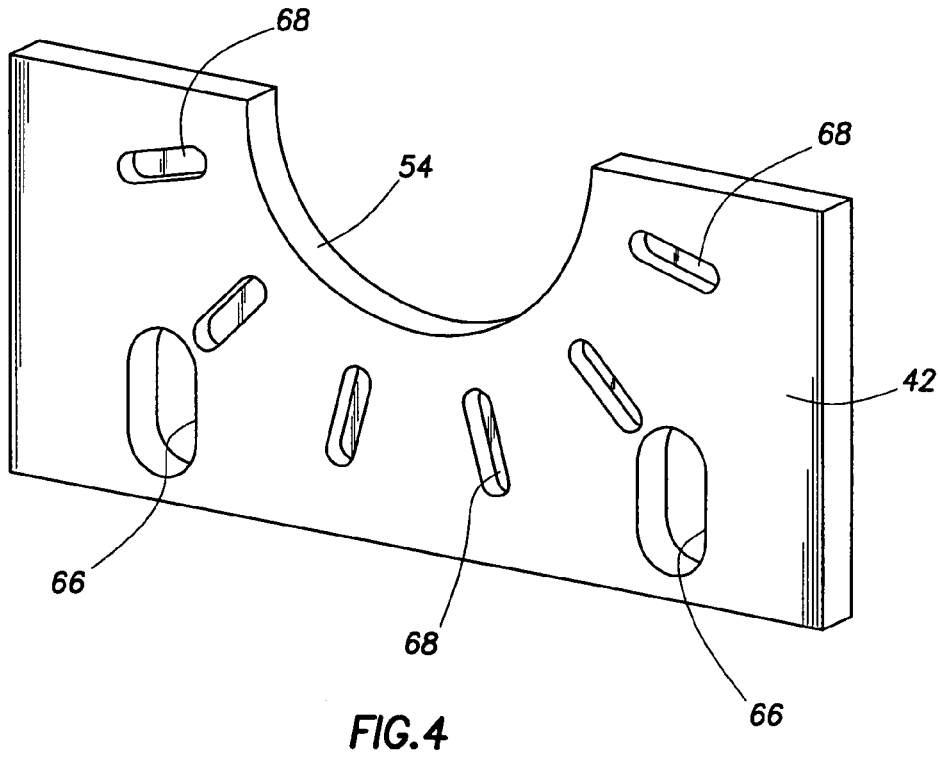
FIG. 4 is a perspective view of one of either an upper or a lower plate.

FIG. 4 shows the upper plate 42 (or a lower plate 44, since they are constructed in a similar manner). The plate 42 includes openings 66 to receiving vertical support members that extend between the plate 42 and the plate 44. The plate 42 also includes a plurality of grooves or recesses 68, each of which is configured and adapted to receive a pin 49. Note that each pin slides within its recess radially inwardly, thereby applying an inward sealing pressure against a tubular within the BOP. The grooves or recesses 68 further provide the feature of capturing a respective vertical pin 49, and thus the sealing element, so that in the event that the polymeric material of the ram breaks up or is expended, the sealing element is retained by the upper and lower plates 42 and 44 and does not fall down hole.

Figure 5:
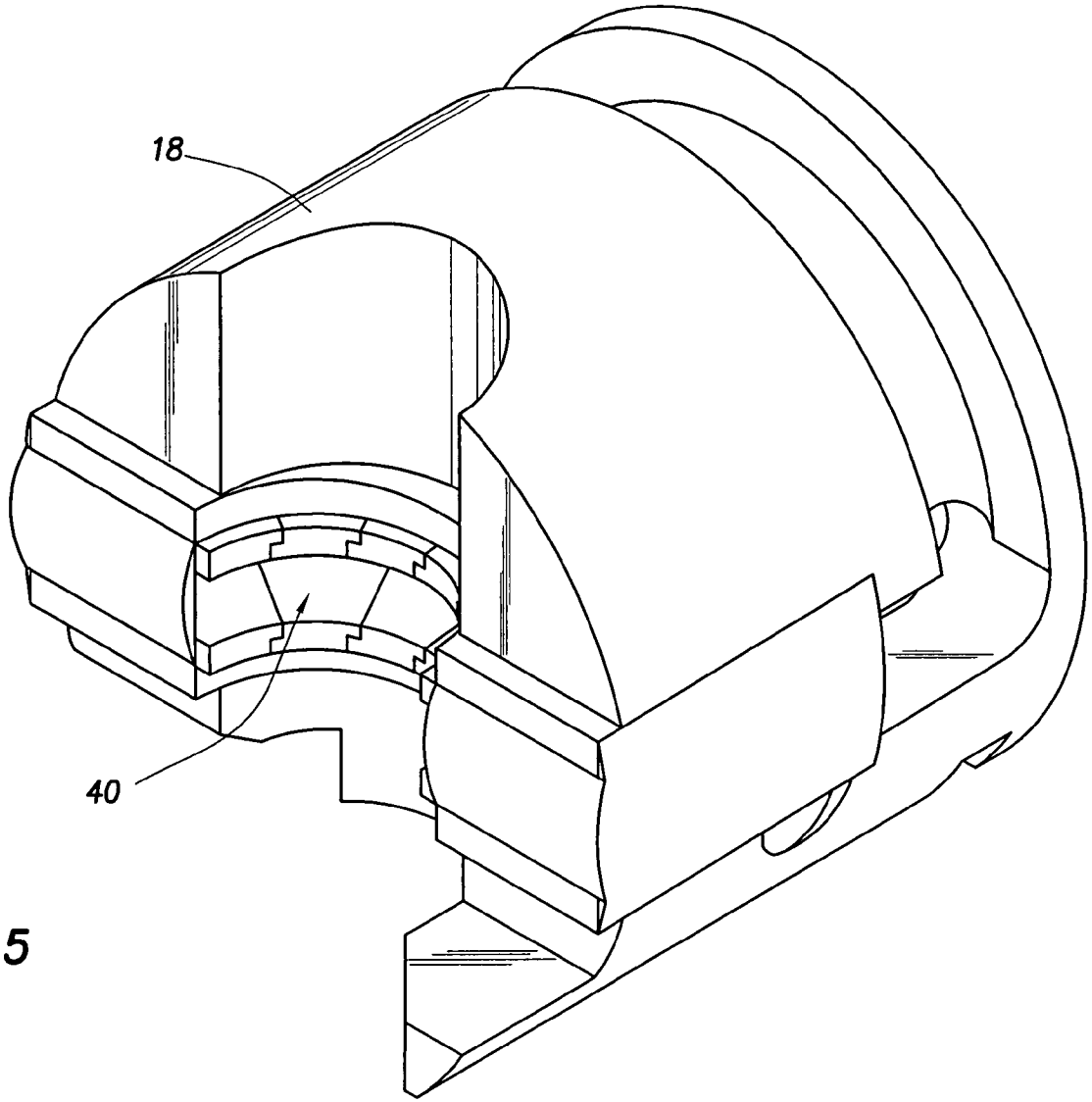
FIG. 5 is a perspective view of a ram showing the placement of the packer.

FIG. 5 shows the ram element 40 operatively mounted in a ram 18 as previously described in respect of FIG. 1. FIGS. 6A through 6D show various views of the wedge-shaped element comprised of pie-shaped sections 46 and 48 with a rib 52 therebetween.

The principles, preferred embodiment, and mode of operation of the present invention have been described in the foregoing specification. This invention is not to be construed as limited to the particular forms disclosed, since these are regarded as illustrative rather than restrictive. Moreover, variations and changes may be made by those skilled in the art without departing from the spirit of the invention.

We claim:

1. A variable bore ram packer comprising:

a. an upper plate;

b. a lower plate;

c. plurality of wedge-shaped segments between the upper and lower plates, where each of the plurality of wedge-shaped segments comprises:

i. a top pie-shaped section;

ii. a bottom pie-shaped section having a non-circular rib recieving recess therein; and iii. a rib between the top and bottom pie-shaped sections, the rib defining a non-circular cross section of a size and shape to slidingly engage the recess in the bottom pie-shaped section; and d. an elastomeric material supported by the wedge-shaped segments.

2. The packer of claim 1, wherein the elastomeric material fills in between the top and bottom pie-shaped sections and around the rib.

3. The packer of claim 1, wherein the top section includes a straight edge with a step therealong, adapted to mate with a complementary step along a straight edge of an adjacent top section.

4. The packer of claim 1, wherein the bottom section includes a straight edge with a step therealong, adapted to mate with a similar step along a straight edge of an adjacent bottom section.

5. The packer of claim 1, wherein the top section defines an undersurface and further comprising a groove in the undersurface to receive the rib.

6. The packer of claim 1, further comprising:

a. an upper pin extending from the top section;

b. a bottom pin extending from the bottom section;

c. a recess in the upper plate to receive the upper pin; and d. a recess in the lower plate to receive the bottom pin.

7. A variable bore ram packer comprising:

a. an upper plate;

b. a lower plate;

c. plurality of wedge-shaped segments between the upper and lower plates, wherein each of the plurality of wedge-shaped segments comprises:

i. a top pie-shaped section having a non-circular rib-recieving recess therein;

ii. a bottom pie-shaped section; and a rib between the top and bottom pie-shaped sections, the rib defining a non-circular cross section of a size and shape to slidingly engage the recess in the top pie-shaped section; and d. an elastomeric material supported by the wedge-shaped segments.

* * * * *